US005556290A

United States Patent [19]

Northey et al.

[11] Patent Number: 5,556,290

[45] Date of Patent: Sep. 17, 1996

[54] SELF-SWITCHING CONNECTOR FOR ELECTRONIC SYSTEMS

[75] Inventors: William A. Northey, Etters; Harold W. Sundy, Landisburg, both of Pa.

[73] Assignee: Berg Technology, Inc., Reno, Nev.

[21] Appl. No.: 439,861

[22] Filed: May 12, 1995

Related U.S. Application Data

[63] Continuation of Ser. No. 108,051, Aug. 17, 1993, abandoned.

[51] Int. Cl.[6] ..... H01R 13/703

[52] U.S. Cl. ..... 439/188

[58] Field of Search ..... 439/188, 620; 200/51.1

[56] References Cited

U.S. PATENT DOCUMENTS

| | | | |
|---|---|---|---|
| 4,224,486 | 9/1980 | Zimmerman, Jr. | 200/51.1 |
| 4,585,284 | 4/1986 | Koser et al. | 439/76 |
| 4,687,888 | 8/1987 | Hasircoglu | 200/51.1 |
| 4,857,002 | 8/1989 | Jensen | 439/76 |
| 4,882,554 | 11/1989 | Akaba et al. | 200/51.1 |
| 4,948,376 | 8/1990 | Penning | 200/51.1 |
| 4,993,957 | 2/1991 | Shino | 439/86 |
| 5,086,284 | 2/1992 | Mouissie | 335/205 |
| 5,409,387 | 4/1995 | Northey et al. | 439/188 |

OTHER PUBLICATIONS

*ESD Protective Serpentine Block Design,* reproduced from Research Disclosure, Feb. 1991, No. 322, Kenneth Mason Publications Ltd., England.

*Silver Zebra® Low Resistance Elastomeric Connections Product Description and Design Recommendations,* Fujipoly, Inc. of Cranford, New Jersey.

*Primary Examiner*—Neil Abrams

*Attorney, Agent, or Firm*—Woodcock Washburn Kurtz MacKiewicz & Norris

[57] ABSTRACT

A self-switching interposer (10) for connecting a mating connector, such as a connector on the end of a cable, to a connector interface, such as a multi-pin connection socket on an electronic computer, includes a housing (12,16), first and second (24) sets of terminals supported in the housing, and a printed circuit board (30) for electrically connecting the first and second sets of terminals. The interposer further includes a switching system (42) for electrically connecting at least a group of the connected terminals to an electronic network (52) when the housing is not mated to a mating connector. The switching system includes a mechanical actuator (60) for disconnecting the group of connected terminals from the electronic network when the housing is mated to a mating connector. As a result, the interposer (10) will connect the connector interface to the network (52) except when the interposer is mated with a mating connector. The network may be used as a terminator circuit, a testing circuit, or for other purposes.

15 Claims, 8 Drawing Sheets

| | | | |
|---|---|---|---|
| J | 2 | OPEN | NETWORK |
| • | 3 | GROUND | GROUND |
| • | 4 | OPEN | NETWORK |
| • | 5 | GROUND | GROUND |
| • | 6 | OPEN | NETWORK |
| • | 7 | GROUND | GROUND |
| • | 8 | GROUND | GROUND |
| • | 9 | OPEN | NETWORK |
| • | 10 | GROUND | GROUND |
| • | 11 | OPEN | NETWORK |
| • | 12 | GROUND | GROUND |
| J | 13 | OPEN | NETWORK |

SELF-SWITCHING CONNECTOR FOR ELECTRONIC SYSTEMS

This is a continuation, of application Ser. No. 08/108,051, filed Aug. 17, 1993 and now abandoned.

BACKGROUND OF THE INVENTION

1. Field of the Invention

This invention relates to electrical connectors, and more particularly, to a self-switching interposer for connecting a cable connector to a cable interface that is designed to electrically connect terminals therein to an internal electrical network based on whether the interposer is mated or not mated to a cable connector or a cable interface.

2. Description of the Prior Art

Multi-terminal electrical connectors are used in modern electronic equipment, such as computers, for connecting various electronic components, such as printers, memory units, display units, etc., to another unit, such as a central processor of a computer. A mainframe computer system may have several such components connected to its central processor. Plug-type connectors are particularly suited for use with modular system designs, and allow quick and easy assembly, disassembly and reconfiguration of a modular system.

An interposer is a unit for facilitating a multi-terminal electrical connection between, for example, a first connector that is provided at the end of a cable, and a connector interface that is provided on a component, such as a central processor of a computer. By using an interposer to make and break the connection, wear on the connector and connector interface is reduced. An interposer will typically include a housing, a first set of terminals for mating with the first connector, and a second set of terminals for mating with the cable interface. In many applications, it is desirable to periodically test system performance by measuring signal characteristics from one or more of the pins or terminals in a connector or connector interface. For some systems, test plugs have been developed that are designed to be plugged into a connector or interface to test a particular function. Unfortunately, it requires an affirmative decision to test the system on the part of an operator or technician before such a test plug will be used. As a result, system operation may not be checked at optimum service intervals. In addition, test plugs are easily misplaced, and cannot be used if an interposer or mating connector is mated to a connector interface.

In many systems, an unconnected connector interface or connector must ideally be connected to a terminator circuit or network to avoid system malfunction or damage. The most common example of a terminator circuit is an impedance-type or resistive-type terminator plug for maintaining a certain design impedance between selected terminals and pins in the connector interface or connector when it is not mated.

Unfortunately, it has in the past been necessary to remove any test plug or terminator plug before installing a mating connector, or to remove the mating connector before installing a test plug or terminator.

It is clear that there has existed a long and unfilled need in the prior art for an improved interposer or connector for an electronic system that will permit a connector interface to be connected to an electronic network without first removing the interposer or connector, or vice versa.

SUMMARY OF THE INVENTION

Accordingly, it is an object of the invention to provide an improved interposer or connector for an electronic system that will permit a connector interface to be connected to an electronic network without first removing the interposer or connector, or vice versa.

It is further an object of the invention to provide an improved interposer or connector that is designed to electrically connect and disconnect terminals therein with an electrical network based on whether the connector or interposer is mated to another connector.

In order to achieve the above and other objects of the invention, a self-switching interposer for connecting a mating connector to a connector interface in an electronic system, includes, according to one aspect of the invention, a housing, a first plurality of terminals supported in the housing, the housing and the first plurality of terminals being constructed and arranged to mate with a mating connector, a second plurality of terminals supported in the housing, the housing and the second plurality of terminals further being constructed and arranged to mate with a connector interface, a connector in said housing for electrically connecting the first plurality of terminals, respectively, to the second plurality of terminals in a predetermined relationship; and a switching system for electrically connecting at least a group of the connected terminals into communication with an electronic network if the housing is not mated to a mating connector, the switching system including a mechanical actuator for disconnecting the group of connected terminals from the electronic network when the housing is mated to a mating connector, whereby a connector interface will be coupled to the network except when the interposer is mated with a mating connector.

According to a second aspect of the invention, a self-switching networking electrical connector assembly for connecting to a mating connector includes a housing, an electrical network, a plurality of terminals supported in the housing, the housing and the terminals being constructed and arranged to mate with a mating connector; and a switching system for electrically connecting at least a group of the terminals to the electrical network when the connector is not mated to a mating connector, and for disconnecting the terminals from the network when the connector is mated to a mating connector, whereby the connector interface will be coupled to the network except when the connector is mated with a mating connector.

According to a third aspect of the invention, a self-switching networking electrical connector assembly for connecting to a mating connector includes a housing, an electrical network, a plurality of terminals supported in the housing, the housing and the terminals being constructed and arranged to mate with a mating connector; and a switching system for electrically connecting at least a group of the terminals between a first position wherein the terminals are connected with the electrical network and a second position wherein the terminals are disconnected from the electrical network, the switching system being constructed and arranged to switch between the first and second positions in response to whether the housing is connected or disconnected to a mating connector.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

Figure 1:
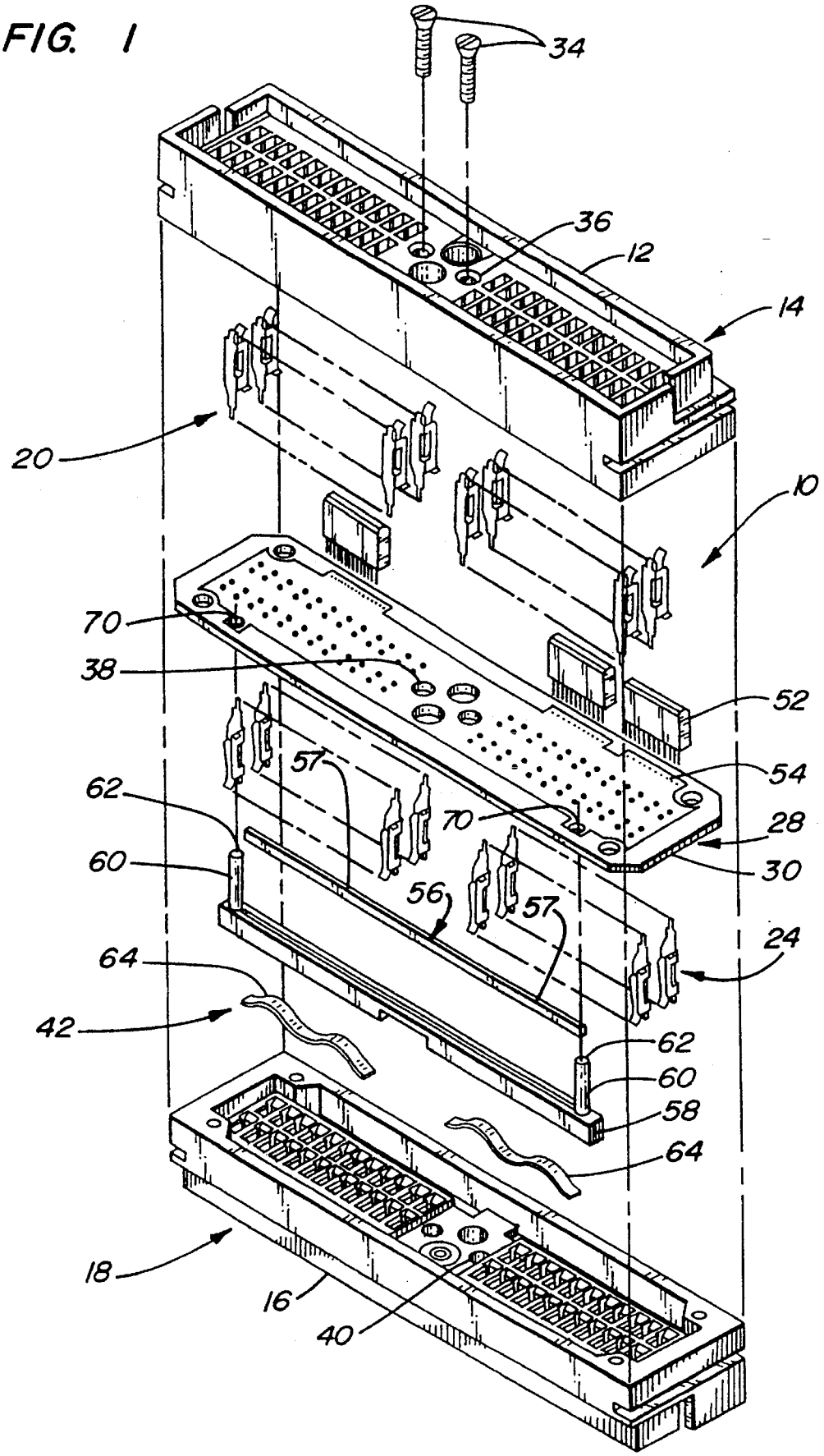
FIG. 1 is an exploded perspective view of a self-switching interposer constructed according to a preferred embodiment of the invention.
Figure 2:
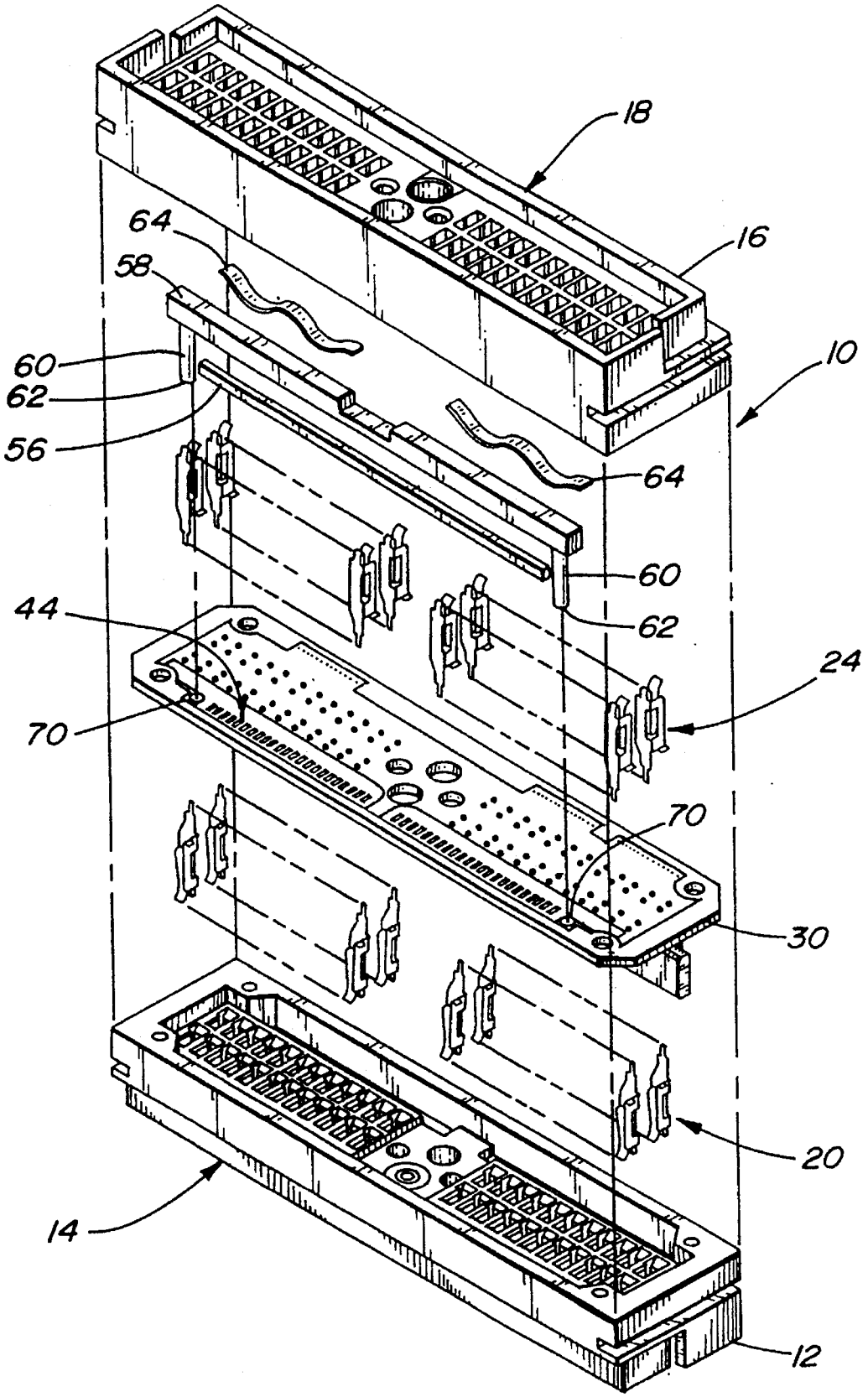
FIG. 2 is an exploded perspective view of the interposer depicted in FIG. 1, taken from a different angle.

Referring now to the drawings, wherein like reference numerals designate corresponding structure throughout the views, and referring in particular to FIGS. 1 and 2, a self-switching interposer 10 for connecting a mating connector 66 to a connector interface in an electronic system includes a housing that includes a first housing member 12 and a second housing member 16. First housing member 12 defines a first end 14 of interposer 10, which is constructed an arranged to mate with a mating connector, such as a connector that may be provided on the end of a cable in an electronic system. Second end 18 is constructed and arranged to mate with a connector interface, such as a multi-pin socket in central processor of an electronic computer system.

Referring again to FIGS. 1 and 2, interposer 10 further includes a first plurality 20 of terminals 22, which are supported in first housing member 12 and are constructed and arranged to mate with terminals in a mating connector 66. Similarly, a second plurality 24 of terminals 26 are supported in second housing member 16, and are constructed and arranged to mate with terminals in a connector interface that is connectable to the second and 18 of interposer 10.

Figure 3:
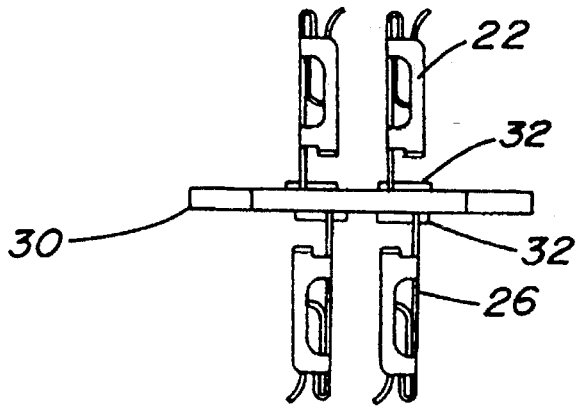
FIG. 3 is a fragmentary cross-sectional view through one component in the system depicted in FIGS. 1 and 2.

A connecting system 28 is provided in the housing between first housing member 12 and second housing member 16 for electrically connecting the respective terminals 22 in the first plurality 20 of terminals to the second type of terminals 26 in the second plurality 24 of terminals. Referring briefly to FIG. 3, it will be seen that connecting system 28 is embodied as a printed circuit board 30, and that the terminals 22 are, respectively, physically and electrically connected to oppositely facing terminals 26 on the opposite side of PC board 30 by electrical connections 32, which are, preferably, soldered connections.

Figure 4:
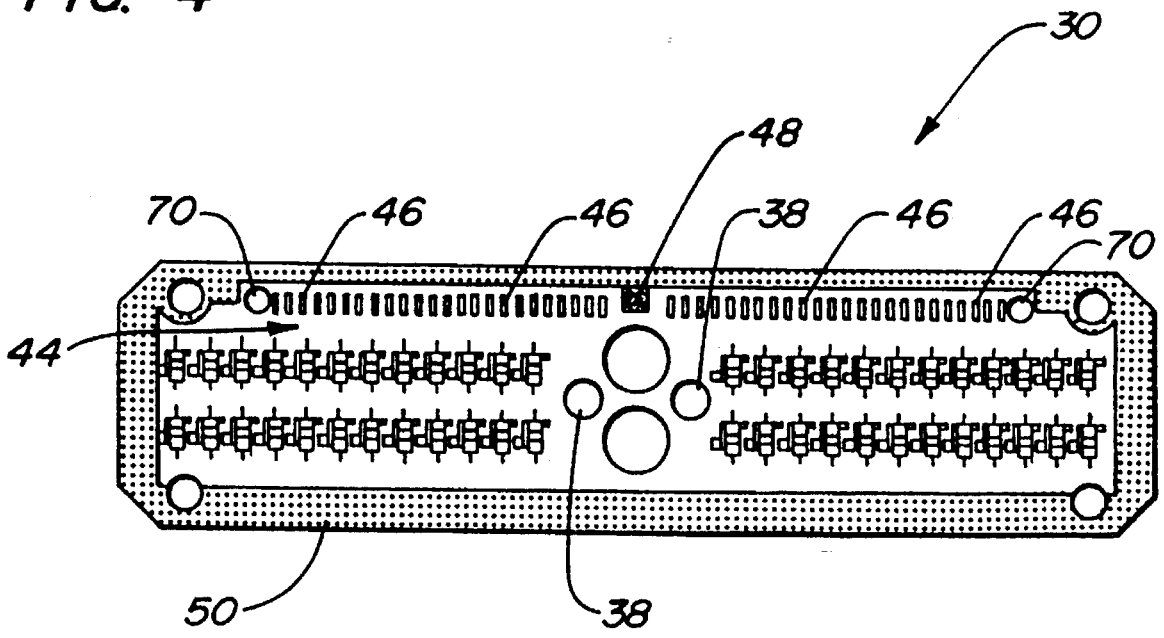
FIG. 4 is a top plan view of one component in the system that is depicted in FIGS. 1–3.

Looking to FIGS. 1, 2 and 4, it will be seen that interposer 10 further includes a pair of screws 34 that are threadable through holes 36 in first housing member 12, then through holes 38 that are defined in printed circuit board 30, and then into holes 40 in the second housing member 16. Screws 34 thus secure first housing member 12, second housing member 16 and printed circuit board 30 into an integral interposer unit.

According to one advantageous aspect of the invention, interposer 10 includes a switching system 42 for electrically connecting at least a group of connected terminals 22, 26 to an electronic network that is contained within the housing if the first and 14 of the first housing member 12 is not mated to a mating connector of 66. In the preferred embodiment, one or more integrated circuit devices 52 are mounted in sockets 54 that are provided in printed circuit board 30, as is best shown in FIG. 1. Integrated circuit devices 52 contain an electronic network that is desired to be connected to a group of terminals 22, 26 during those periods of time when interposer 10 is not connected to a mating connector. Referring to FIGS. 1, 2 and 4, switching system 42 includes a switching area 44 that is defined on printed circuit board 30. As is best shown in FIG. 4, switching area 44 includes a plurality of linearly array of pads 46, each of which is preferably electrically connected to a pair of connected terminals 22, 26 in a manner that is well known to those skilled in the technology of printed circuit boards or integrated circuits in general. A ground pad 48 may also be included in the lineal array of pads 46 in switching area 44. If so included, ground pad 48 is contiguous and is electrically connected with a plated ground area 50 on a periphery of printed circuit board 30. Plated ground area 50 is designed to communicate with system ground, preferably by plated-through grounding holes that are provided on the printed circuit board 30.

As will be described below in greater detail with reference to FIGS. 9 and 10, the leads on the integrated circuit devices 52 are also electrically communicated in a desired relationship with a group of the connected terminals 22, 26, again, through printed circuit board technology that is well known to those skilled in this area.

Referring back to FIGS. 1 and 2, switching system 42 further includes a linear switching bar 56 that has conductive traces deposited thereon in a pattern that is consistent with the desired electrical connections when the second end 18 of interposer 10 is an unconnected state, as will be apparent from the discussion hereinbelow. Switching bar 56 is preferably fabricated from an elastomeric material having conductive material deposited thereon in a conductive area 57, shown in FIG. 1, such as those that are commercially available from Fujipoly Company of Cranford, N.J. As is best shown in FIG. 2, switching bar 56 is supported by a switching bar holder 58. Switching bar 58 has a pair of cam rods 60 depending therefrom, each of which has a cam surface 62 defined on a distal end thereof. As is evident from FIGS. 1, 2 and 5, cam rods 60 extend through a pair of holes 70 in printed circuit board 30, and further extend through a pair of holes, that are defined in first housing member 12. A pair of springs 64 are positioned between switching bar holder 58 and a recess that is defined in the second housing member 16, as may be seen in FIGS. 1 and 2.

Figure 7:
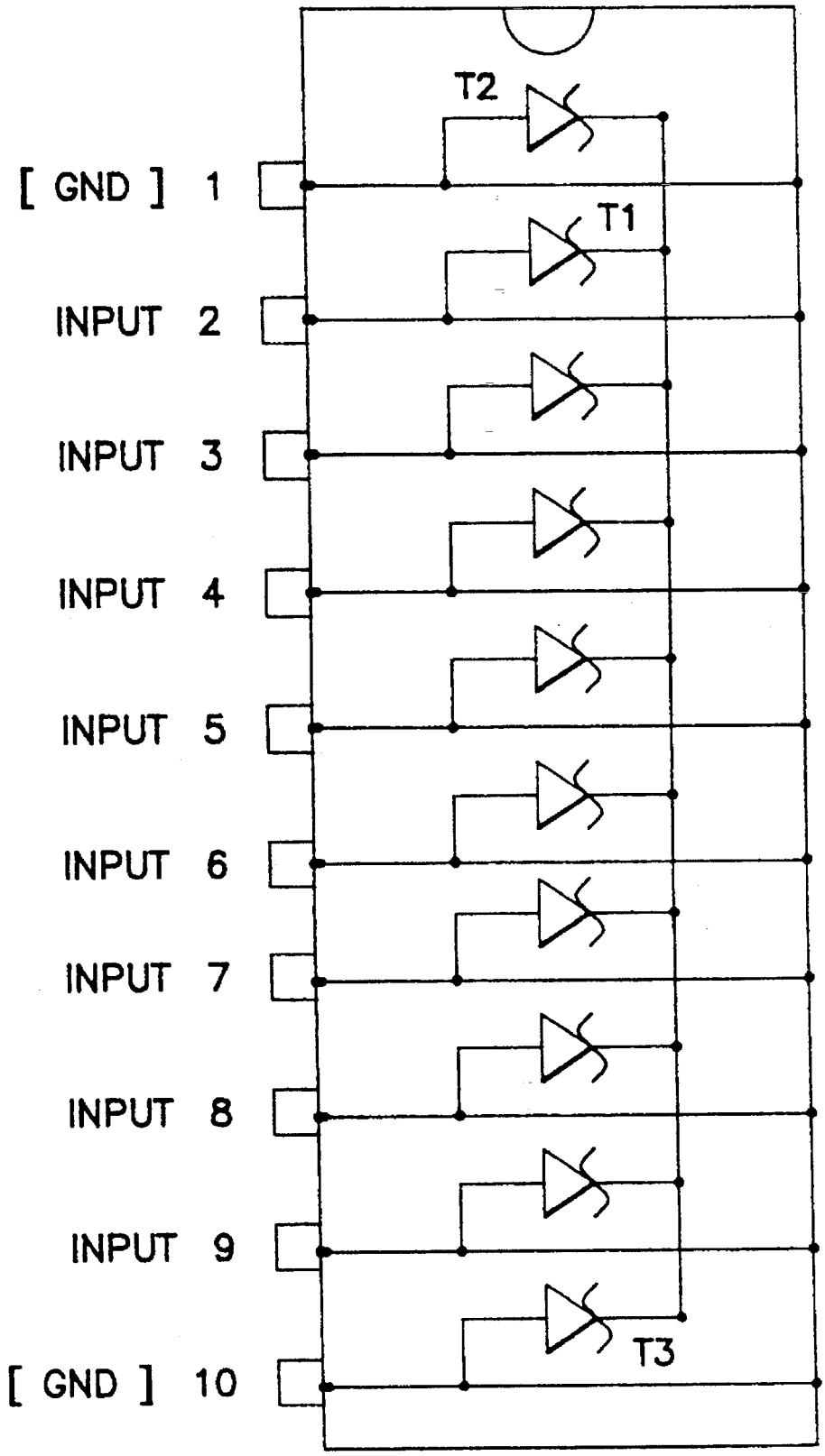
FIG. 7 is a schematic diagram depicting one type of network that may be used in the interposer depicted in FIGS. 1–6.

Referring briefly to FIG. 7, integrated circuit device 52 may contain a network of zener diodes. This type of network might be used to ensure that working voltages in an electrostatic device are not exceeded.

Figure 8:
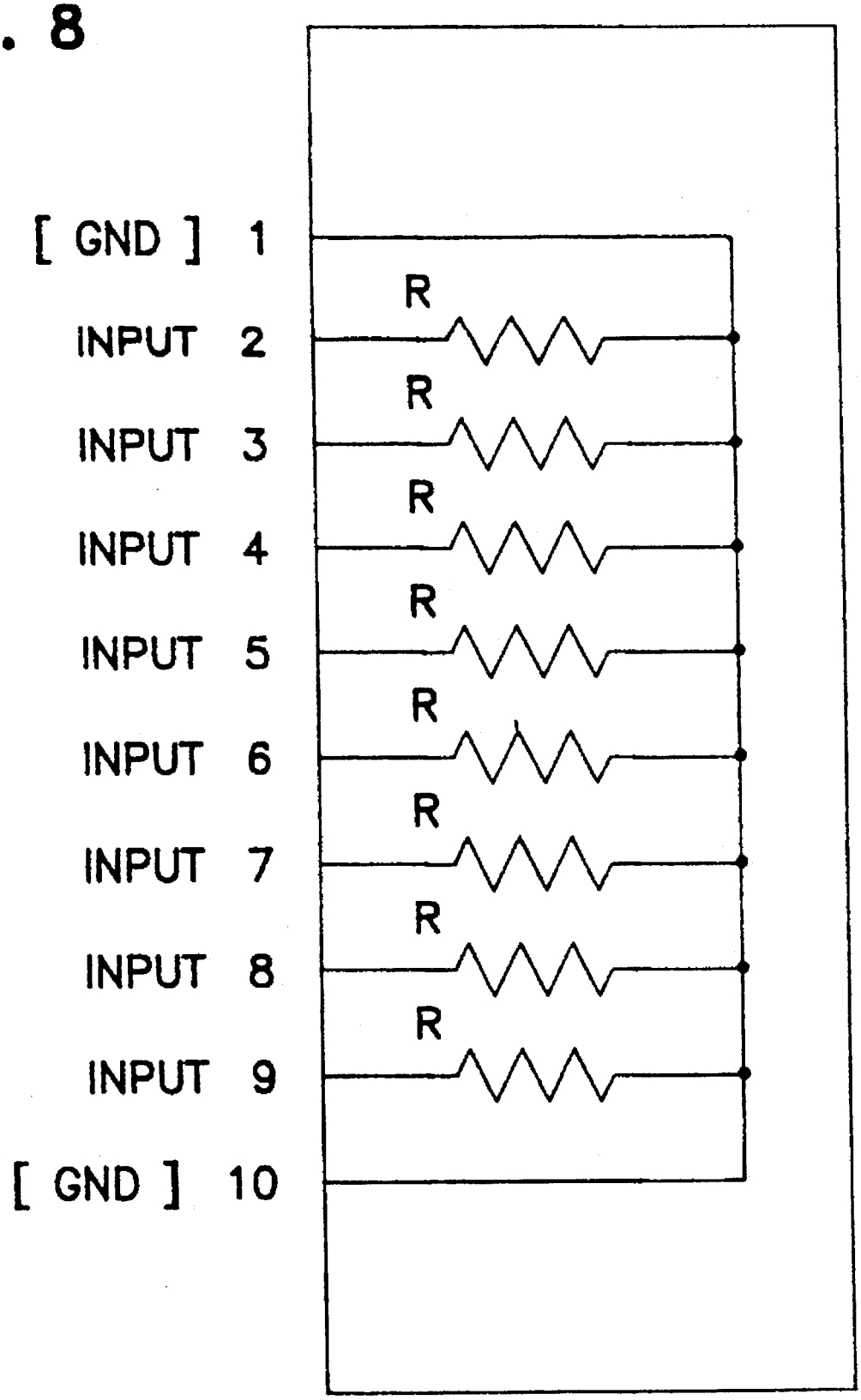
FIG. 8 is a schematic diagram depicting another embodiment of a network which can be used in conjunction with the interposer depicted in FIG. 1–6.

Referring now to FIG. 8, it will be seen that integrated circuit device 52 could, for example, alternatively, contain a resistor network. A resistor network would have applications in termination of a controlled impedance network.

Figure 9:
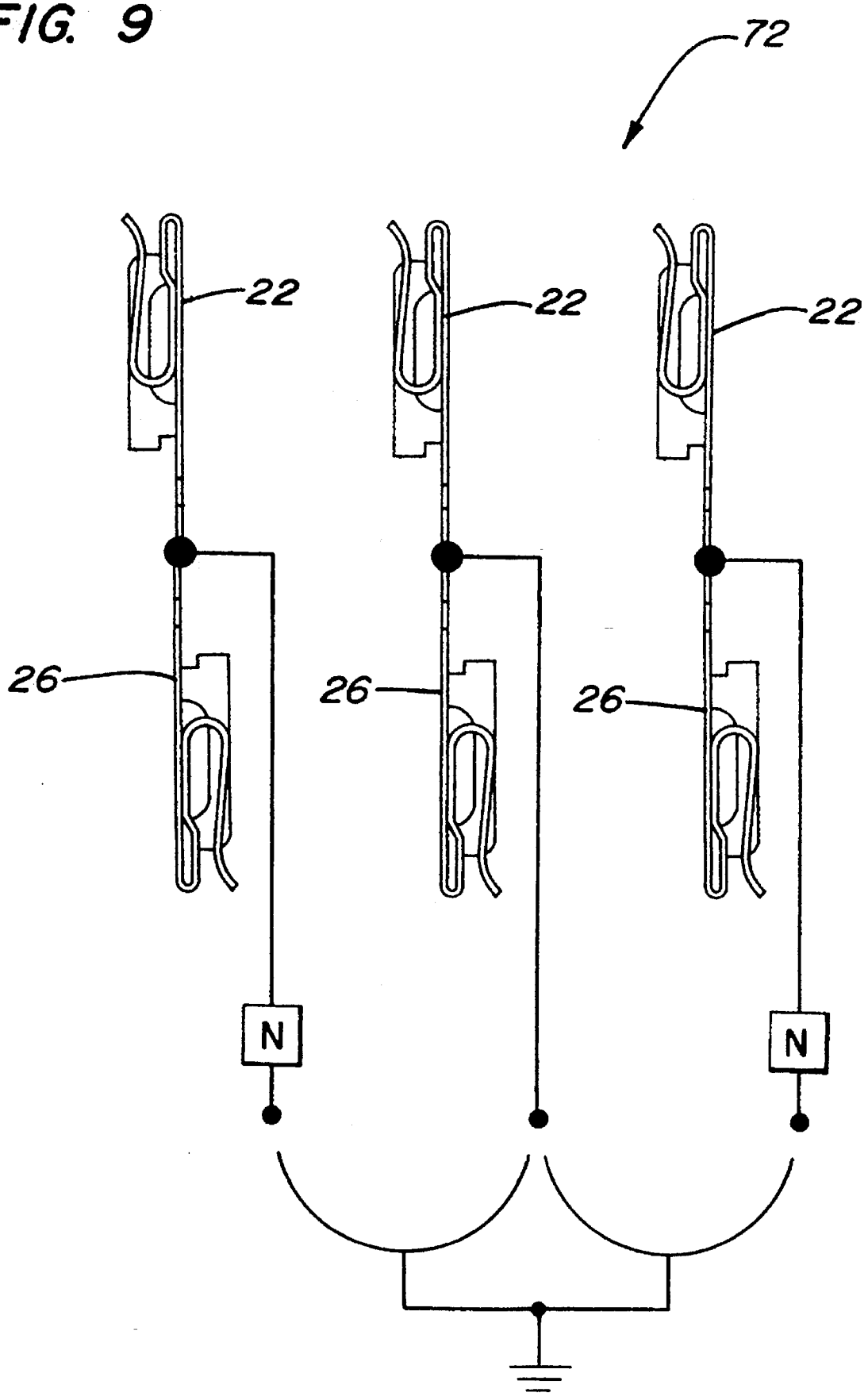
FIG. 9 is a schematic depiction of one type of switching system that can be used in the interposer depicted in FIGS. 1–8.
Figure 10:
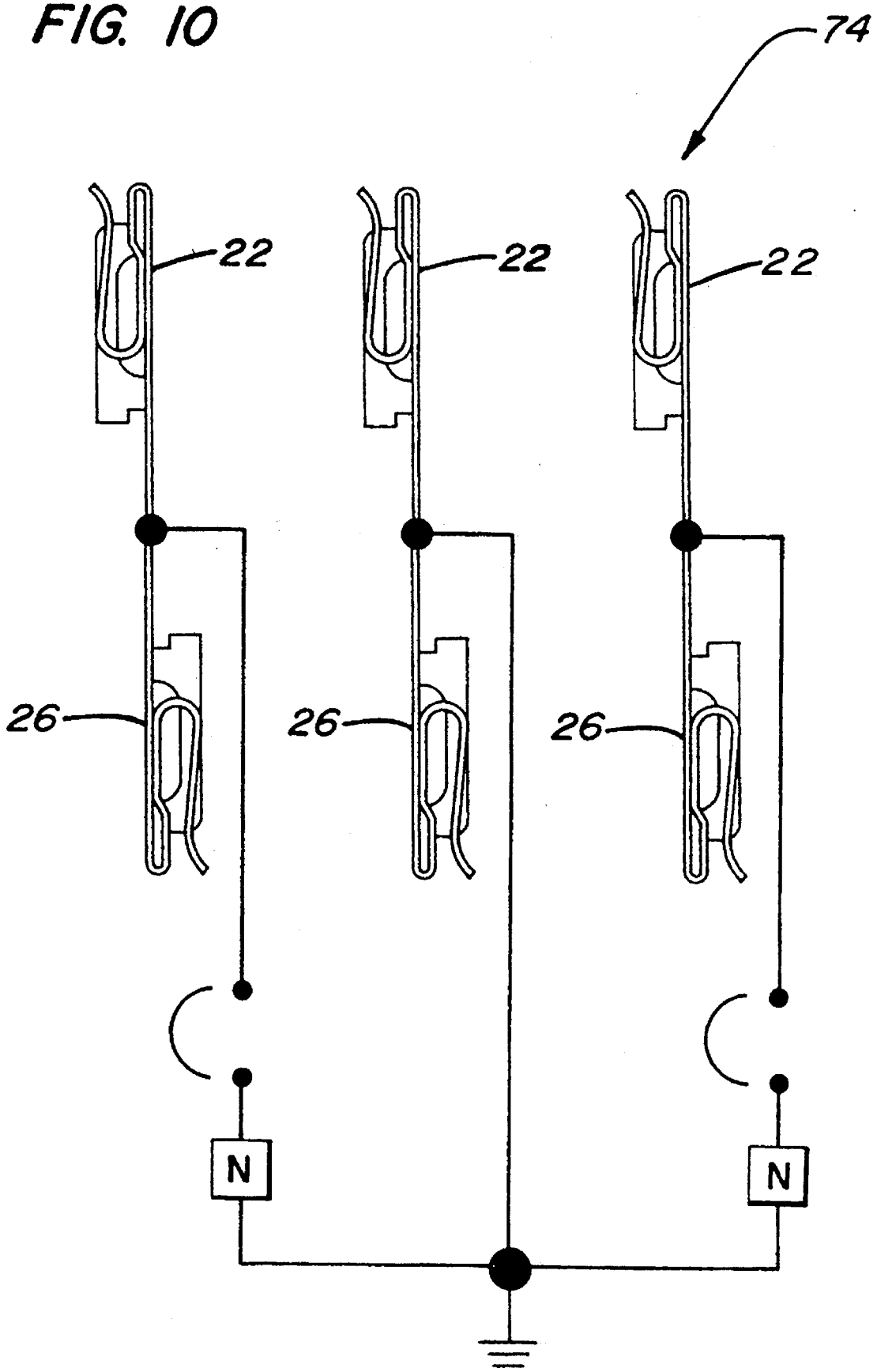
FIG. 10 is a schematic diagram depicting a second type of switching system that can be used in the interposer illustrated in FIGS. 1–8.

Referring now to FIGS. 9 and 10, the switching system 42 could be embodied as a switching system 72 in which some of the connected terminals 22, 26 are connected to ground, while other of the connected terminals 22, 26 are permanently connected to one side of a network. In this embodiment, switching system 72 would, when closed because no mating connector 66 is attached to the first end 14 of interposer 10, connect a second, opposite side of the resistive network to ground, thus completing a circuit through the network.

Alternatively, as shown in FIG. 10, switching system 42 can be embodied as a system 74 in which some of the terminals 22, 26 are permanently connected to both ground and one side of one or more networks. Upon closing of the switching system 74, other pairs of terminals 22, 26, which are signal terminals, would be connected to a second, opposite side of the respective networks.

Figures 5, 6:
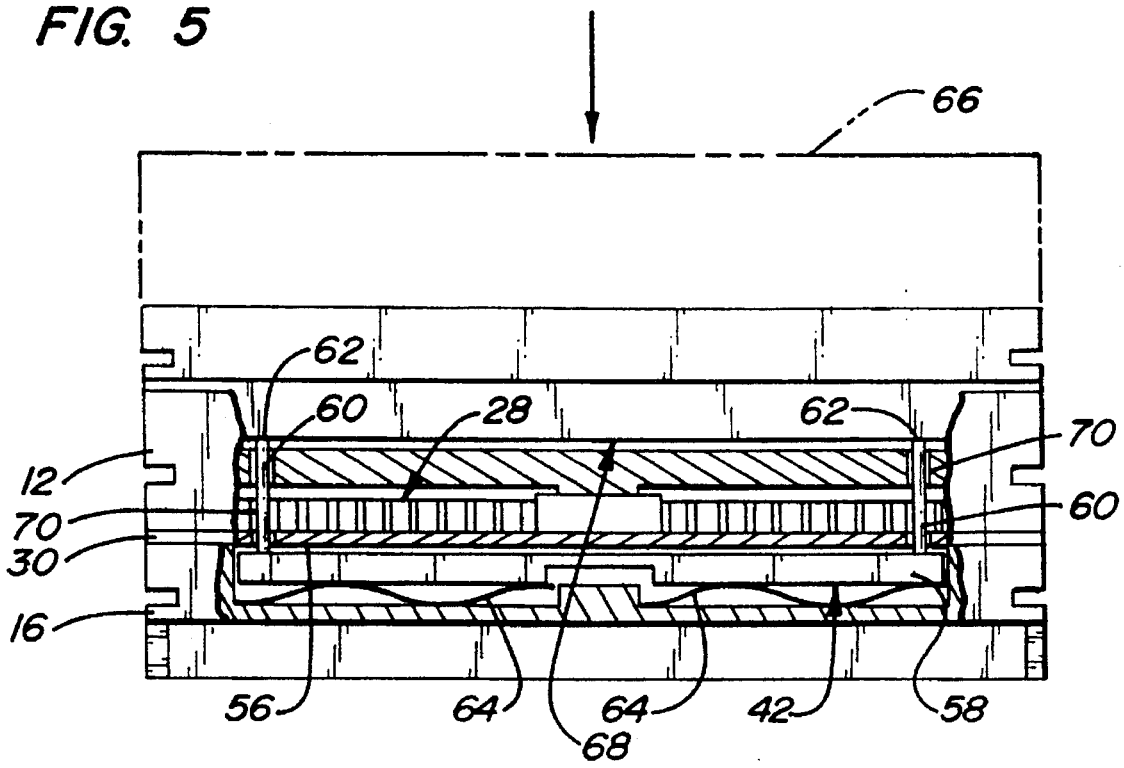
FIG. 5 is a fragmentary cross-sectional view depicting mating of the system depicted in FIGS. 1–4 with a mating connector.
FIG. 6 is an exemplary table depicting operation of the interposer depicted in FIGS. 1–5.

Referring to FIG. 5, in operation, an interposer 10 would typically be permanently connected with screws to a connector interface of an electronic component, such as a controller of a computer system. Preferably, the interposer 10 would be connected to the connector interface in such a manner that the second end 18 of second housing member 16 is mated with the connector interface. If no mating connector is secured to the first end 14 of interposer 10, springs 64 will bias switching bar holder, and thus switching bar 56 against the switching area 44 on the printed circuit board 30. In this state, at least a group of connected terminals 22, 26 will be connected to the network provided in integrated circuit device 52, either as depicted in FIG. 9 or FIG. 10. If, however, a mating connector 66 is inserted into and secured to the first end 14 of interposer 10, as shown in FIG. 5, the surface 68 on the mating connector 66 will bear against the cam ends 62 of cam rod 60, thereby forcing switching bar holder 58, and thus switching bar 56, away from the switching area 44 on printed circuit board 30. In this condition, the group of terminal pairs 22, 26 will be disconnected from the respective networks, and interposer 10 will function normally as an electrical connector between the connector interface and the mating connector 66.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A self-switching interposer for connecting a mating connector to a connector interface in an electronic system, comprising:

a housing;

a first plurality of terminals supported in said housing, said housing and said first plurality of terminals being constructed and arranged to mate with a mating connector;

a second plurality of terminals supported in said housing, said housing and said second plurality of terminals further being constructed and arranged to mate with a connector interface;

connecting means in said housing for electrically connecting said first plurality of terminals, respectively, to said second plurality of terminals in a predetermined relationship; and switching means for electrically connecting at least a group of said pluralities of connected terminals with an electronic network if said housing is not mated to a mating connector, said switching means comprising an elongated switching bar having an electrically conductive pattern thereon for engaging a switching area on said connecting means that comprises a row of contacts, connected to said group of terminals and said network, when said housing is not fully mated to its respective connector interface or mating connector, said switching means further comprising mechanical means for disconnecting said switching bar from said switching area when said housing is mated to a mating connector, said electrically conductive pattern being consistent with desired electrical connections between said contacts, whereby a connector interface will be coupled to said network except when said interposer is mated with a mating connector.

2. An interposer according to claim 1, wherein said connecting means comprises a printed circuit board.

3. An interposer according to claim 1, wherein said switching bar comprises a conductive elastomeric portion for engaging said area on said printed circuit board.

4. An interposer according to claim 1, wherein said switching means further comprises biasing means for biasing said switching bar toward said area on said printed circuit board.

5. An interposer according to claim 4, wherein said biasing means comprises at least one spring.

6. An interposer according to claim 1, wherein said mechanical disconnecting means comprises cam means for urging said switching bar away from said area on said printed circuit board when said cam means engages a mating connector.

7. An interposer according to claim 1, wherein said network comprises a resistive network.

8. An interposer according to claim 1, wherein said network comprises a zener diode network.

9. An interposer according to claim 1, wherein said network has one side in permanent communication with said terminals, and a second side, and said switching means is constructed and arranged to communicate said second side to a ground area on said printed circuit board if said housing is not mated to a mating connector.

10. An interposer according to claim 1, wherein said network has one side in permanent communication with ground, and a second side, and said switching means is constructed and arranged to communicate said second side to said terminals if said housing is not mated to a mating connector.

11. A self-switching networking electrical connector assembly for connecting to a mating connector, comprising:

a housing;

an electrical network;

a plurality of terminals supported in said housing, said housing and said terminals being constructed and arranged to mate with a mating connector; and switching means for electrically connecting at least a group of said terminals to said electrical network when said connector is not mated to a mating connector, and for disconnecting said terminals from said network when said connector is mated to a mating connector, said switching means comprising a printed circuit board that is mounted to said housing and has a switching area defined thereon having a row of contacts thereon that are connected to said group of terminals and said network and an elongated conductive switching bar having an electrically conductive pattern thereon that is constructed and arranged to engage said contacts in a predetermined electrical manner when said connector assembly is not fully mated to a mating connector, and to withdraw from contact from said contacts when said connector assembly is fully mated to a mating connector, whereby said connector interface will be coupled to said network except when said connector is mated with a mating connector.

12. A connector assembly according to claim 11, wherein said switching means means comprises mechanical means for disconnecting said group of terminals from ground when said connector assembly is substantially fully mated to a mating connector.

13. A connector assembly according to claim 11, wherein said switching means further comprises biasing means for biasing said switching bar toward said switching area on said printed circuit board.

14. A connector assembly according to claim 1, wherein said biasing means comprises at least one spring.

15. A self-switching networking electrical connector assembly for connecting to a mating connector, comprising:

a housing;

an electrical network;

a plurality of terminals supported in said housing, said housing and said terminals being constructed and arranged to mate with a mating connector; and switching means for electrically connecting at least a group of said terminals to said electrical network when said connector is not mated to a mating connector, and for disconnecting said terminals from said network when said connector is mated to a mating connector, said switching means comprising a printed circuit board that is mounted to said housing, said printed circuit board having a a switching area defined thereon that contains a row of contacts that are connected to said group of terminals and said network, and an elongated conductive switching bar that is constructed and arranged to engage said contacts when said connector assembly is not fully mated to a mating connector, and to withdraw from contact from said contacts when said connector assembly is fully mated to a mating connector, said switching bar comprising a conductive elastomeric material that is arranged according to a electrically conductive pattern, whereby said connector interface will be coupled to said network except when said connector is mated with a mating connector.

* * * * *